US008627974B2

(12) United States Patent
Francis

(10) Patent No.: US 8,627,974 B2
(45) Date of Patent: Jan. 14, 2014

(54) WASTE COLLECTION AND DISPOSAL DEVICE

(76) Inventor: Ajax Carl Francis, Pembroke Pines, FL (US)

( * ) Notice: Subject to any disclaimer, the term of this patent is extended or adjusted under 35 U.S.C. 154(b) by 0 days.

(21) Appl. No.: 13/584,913

(22) Filed: Aug. 14, 2012

(65) Prior Publication Data

US 2013/0056465 A1 Mar. 7, 2013

Related U.S. Application Data

(60) Provisional application No. 61/531,139, filed on Sep. 6, 2011.

(51) Int. Cl.

| | |
|---|---|
| ***B65D 21/02*** | (2006.01) |
| ***A01K 29/00*** | (2006.01) |
| ***A01K 23/00*** | (2006.01) |

(52) U.S. Cl.

USPC ..... 220/23.91; 294/1.3; 119/867

(58) Field of Classification Search

USPC ..... 294/1.3; 220/23.91; 119/867; D30/161, D30/162; 43/58, 60, 61, 62

See application file for complete search history.

(56) References Cited

U.S. PATENT DOCUMENTS

| | | | | | |
|---|---|---|---|---|---|
| 2,289,802 | A | * | 7/1942 | Norton | 119/793 |
| 2,967,729 | A | * | 1/1961 | Davis | 294/180 |
| 3,885,266 | A | | 5/1975 | Nafziger | |
| 4,017,015 | A | * | 4/1977 | Jefferson | 294/1.3 |
| 4,215,888 | A | * | 8/1980 | Gavin et al. | 294/1.3 |
| 4,272,116 | A | * | 6/1981 | Tufte, Jr. | 294/1.3 |
| D262,943 | S | * | 2/1982 | Schadler | D30/162 |
| 4,529,236 | A | * | 7/1985 | Vogt | 294/1.3 |
| 4,830,419 | A | * | 5/1989 | Watanabe | 294/1.3 |
| 4,865,371 | A | * | 9/1989 | Egberg | 294/1.3 |
| 4,974,893 | A | | 12/1990 | Grahn | |
| 5,020,185 | A | * | 6/1991 | Hoefler | 15/257.1 |
| 5,186,384 | A | | 2/1993 | Nelson | |
| D334,638 | S | * | 4/1993 | Blackman | D30/162 |
| 5,318,330 | A | * | 6/1994 | Dombrowski | 294/1.3 |
| 5,829,671 | A | | 11/1998 | Hawk | |
| 6,135,519 | A | * | 10/2000 | Kotlinski | 294/1.3 |
| 6,234,549 | B1 | * | 5/2001 | Brownell | 294/1.3 |
| 6,527,320 | B1 | * | 3/2003 | Gregg | 294/1.3 |
| D490,943 | S | * | 6/2004 | Logan | D30/162 |
| 6,964,247 | B1 | | 11/2005 | Lin | |
| 2008/0173643 | A1 | * | 7/2008 | Wadsworth et al. | 220/8 |

* cited by examiner

*Primary Examiner* — Steven A. Reynolds
*Assistant Examiner* — Javier A Pagan
(74) *Attorney, Agent, or Firm* — Daniel Boudwin; Global Intellectual Property Agency, LLC

(57) ABSTRACT

A system for the sanitary collection and disposal of pet waste is disclosed. The system comprises adjacent male and female receptacles connected by a pull string. The male receptacle contains an open bottom for the purpose of being deployed over targeted waste, while the female receptacle contains an opening most adjacent to the male receptacle in order to allow for their joining. The user secures the female receptacle and applies a tension to the pull string, allowing the smaller dimensioned male envelope to be pulled into the female receptacle interior, thereby capturing the waste within the assembly utilizing the tapered bottom edge of the female receptacle as a scooping mechanism. This process can be accomplished from the standing position while supporting the female receptacle with one foot and utilizing one arm to drawn in the male receptacle, providing flexibility for users and eliminates contact concerns with the waste product.

4 Claims, 2 Drawing Sheets

FIG. 1
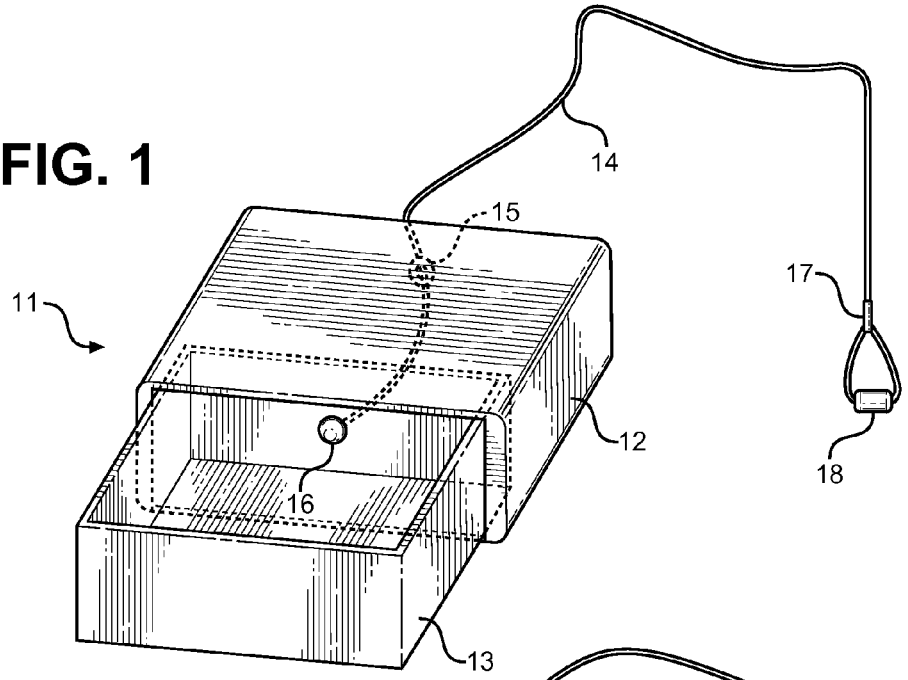
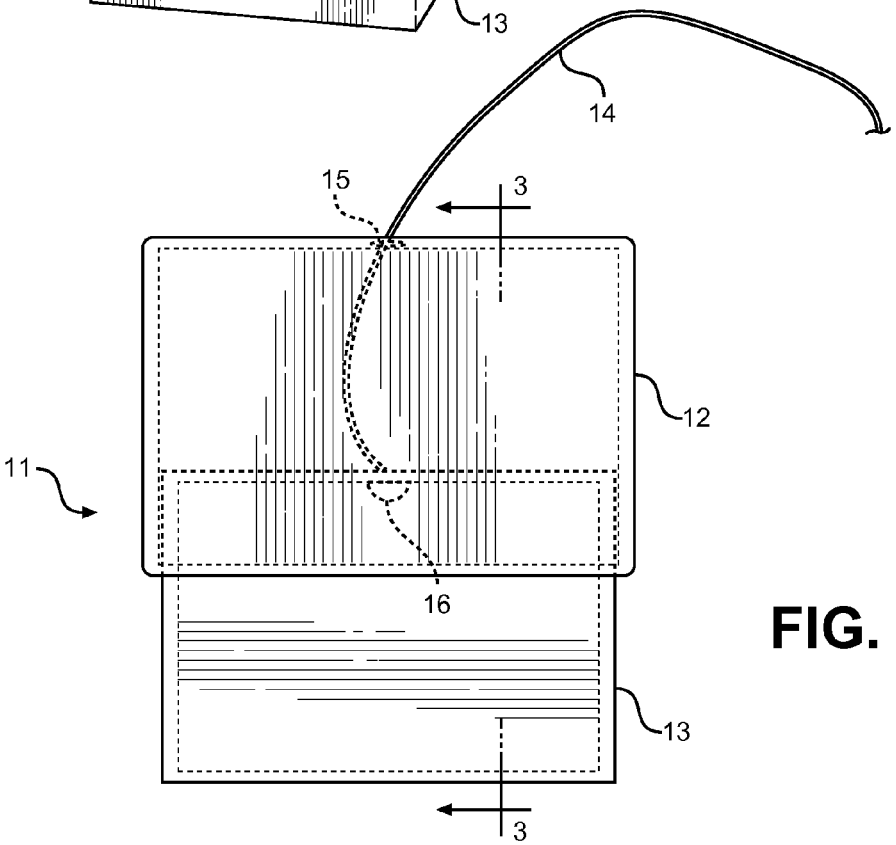
FIG. 2

WASTE COLLECTION AND DISPOSAL DEVICE

CROSS REFERENCE TO RELATED APPLICATION

This application claims the benefit of U.S. Provisional Application No. 61/531,139 filed on Sep. 6, 2011, entitled "Disposable Poo Scoop." The patent application identified above is incorporated here by reference in its entirety to provide continuity of disclosure.

BACKGROUND OF THE INVENTION

1. Field of the Invention

The present invention relates to waste collection and disposal devices. More specifically, the present invention relates to an inexpensive containment system for capturing waste that includes two adjacent receptacles connected by a means to join them. While in the standing position, a user stabilizes the female receptacle while applying a tangential force along the joining means, thus forcing the male receptacle to move toward the female receptacle, enclosing the desired waste and thereby providing a sanitary means for collection and disposal thereof.

The collection and proper disposal of pet waste represents a prevalent concern in modern society. Due to a direct correlation between the severity of this issue and the overpopulation of a specific area, major metropolitan cities were the first to realize the potential hazards of this growing problem. However, in recent years a steadily increasing population has shifted focus to newly affected rural areas that are beginning to face the consequences of not addressing this issue. Some municipalities have gone as far as enacting ordinances to neutralize the pet waste epidemic by requiring owners to dispose of the waste or risk a large fine.

A significant motivation behind the proper collection and disposal of pet waste relates to serious health concerns that can arise from its improper handling. Pet waste carries bacteria, parasites and viruses that can support Zoonosis, which are diseases that cross between species. These diseases can have a dramatic affect on humans, especially children, who have weaker immune systems and are more willing to play with foreign objects found in nature due to their curious temperament. According to the U.S. Center of Disease Control and Prevention (CDC) pet waste left unattended runs the risk of attracting the eggs of certain roundworms and parasites that lay dormant in the soil for years looking for a suitable host. These issues create a demand for a device that provides a sanitary and comfortable means to collect and dispose of pet waste.

Another important aspect of the pet waste epidemic is the corresponding environmental impact that is associated with improper disposal. Pet waste that is not sanitarily collected has a high probability of ending up in storm drains that run through our cities, some of which circumvent the local treatment facility opting to feed into local bodies of water. As time passes, the waste reduces oxygen levels within the water supply, emits ammonia and introduces bacteria, viruses and parasites to the ecosystem, all of which have a drastic impact on wildlife. The waste also contains nutrients that promote the formation of algae and weeds, which can detract from the natural beauty of the landscape thereby providing an unattractive, as well as unsafe, atmosphere. By these reasons a comfortable and efficient means for disposing pet waste is a necessity.

2. Description of the Prior Art

The present invention addresses the prominent shortcomings relating to pet waste collection and disposal devices that commonly reside in the art. The majority of devices in the art contain similar methods for collecting the waste, which commonly requires a user to bend down below the waist, physically scoop up the waste in some form of a receptacle and then seal the receptacle thereby containing the waste. This action promotes possible skin contact with fecal matter which is a serious health concern, as well as limits the usability of the device relating to users who possess medical impairments, are unable to bend below the waste or would rather deploy the device with only one hand. The present invention addresses these issues with a solution that is deployed while remaining in the standing position and requires the use of only one hand. Therefore, the present invention differs dramatically in both structure and spirit from devices currently found in the art and is ideally suited for personal use when a user has a need for sanitarily removing pet waste from a given surface for future disposal. The following devices are the most prevalent in the prior art relating to waste collection and disposal devices.

U.S. Pat. No. 5,829,671 to Hawk is one such device in the art that describes a means for the collection and disposal of waste comprising a rectangular carton for holding waste and a handle for transportation. The carton itself comprises a front wall, a back wall, a pair of side walls, a bottom wall and a top wall that contains lateral gussets, which fold into a scoop configuration. Once the waste is deposited into the carton an integrated folding lid is deployed to fully enclose the waste to prevent any emanating odor from reaching a user. The Hawk device supplies a simple and inexpensive means to collect and dispose of waste yet fails to meet the level of ergonomics set forth by the present invention. In order to deploy the Hawk device a user must bend over to physically collect the waste, which can lead to contact with fecal matter thereby providing an opportunity to pass along various diseases to a user. The requirement to bend below the waste may also represent a physical impossibility relating to people with disabilities, causing undue frustration and hardship.

U.S. Pat. No. 3,885,266 to Nafziger is another device that describes a means for the collection and disposal of pet waste comprising a paperboard blank. In order to construct the intended device from the paperboard blank, a first fold is made and glue is applied to form a collapsed scoop with a detachable pusher. Once constructed, the final shape resembles a pyramid with one side open for the insertion of the pet waste. The overall effectiveness and ease of use relating to this device is subpar when compared to the present invention due to the complexity of assembly, additional time required to form the waste disposal receptacle and amount of space allotted for waste insertion. The paperboard structure leaves little room for error when navigating the device in the waste collection process, which can lead to contact with the waste, and therefore health problems for a user.

U.S. Pat. No. 4,974,893 to Grahn and U.S. Pat. No. 5,186,384 to Nelson are additional devices that describe a means for the collection and disposal of pet waste comprising a receptacle for the waste, an integrated handle for carrying the device and a tool meant to facilitate the transition of the waste into the receptacle. Once the waste is collected, a flap with a means to secure itself to the receptacle is folded over the open area providing a complete seal and therefore containment of the waste and odor. These devices propose an immediate problem to users with pet animals by requiring the use of both arms for the collection of waste. This discomfort may be more prominent for users with disabilities or users with larger pets who after defecating will continue to pull on their means for retention, which will cause frustration and undue stress. The requirement to use both hands in order to capture the waste also doubles the amount of a user's skin involved with the collection process thereby doubling the risk of contact between a user and the waste, raising immediate medical concerns. The present device negates these issues by providing a collection means requiring the use of only one hand that can be accomplished in the standing position.

U.S. Pat. No. 4,017,015 to Jefferson is another device that describes a collapsible kit for the collection and disposal of pet waste comprising a pair of receptacles that each contain a mirrored contour shape on their opened front surface for the purpose of forming a scoop like mechanism. When the desired waste to be collected is identified both of the receptacles approach the waste from either side, ultimately joining while containing the waste therein. Once the waste is collected a tab is revealed on the top surface of the combined receptacle to provide a comfortable means of transportation. This device provides a tightly sealed receptacle for containing the waste as well as an efficient means for transporting the waste yet does not address other prominent issues relating to these devices. By using both hands to collect the waste a user may be pulled by the retention device connected to their pet causing undo frustration and hardship. Also, the use of both hands doubles the risk of contact between a user's skin and the waste raising serious medical concerns.

Finally, U.S. Pat. No. 4,017,015 to Jefferson is a device that describes a collapsible kit for the collection, transport and disposal of pet waste comprising a plurality of flattened boxes, storage space for the contained waste and a means to transport the kit. Contained within the kit are two different types of boxes which originally are flattened to save space but when are unfolded provide a means to collect and seal the waste before being stored in the allotted storage space. Although this device provides a means to collect and store waste it also offers numerous problems that are common relating to similar devices in the art. Carrying multiple boxes to collect waste provides unnecessary discomfort to users who will most likely be collecting one or two deposits per trip. Also, when utilizing this device a user must bend down and use both hands to physically collect the waste. This action exposes the user to serious health issues if coming into contact with the waste as well as provides an opportunity for the animal to pull on its means for retention which will further increase the risk of fecal contact. The present invention negates these issues by deploying in the standing position and not requiring the use of both hands in order to collect the waste.

From the brief description of prominent devices in the art it is plainly gathered that the present invention provides a novel means to collect and dispose of waste and therefore substantially diverges in design elements from the prior art. Consequently it is clear that there is a need in the art for an improvement to existing waste collection and disposal devices. In this regard the instant invention substantially fulfills these needs.

SUMMARY OF THE INVENTION

In view of the foregoing disadvantages inherent in the known types of waste collection and disposal devices now present in the prior art, the present invention provides a new waste collection and disposal device wherein the same can be utilized for providing convenience for the user when collecting, transporting and ultimately disposing of waste.

It is therefore an object of the present invention to provide a new and improved waste collection and disposal device that has all of the advantages of the prior art and none of the disadvantages.

It is another object of the present invention to provide a waste collection and disposal device that can deploy while in the standing position, stabilizing the assembly with one foot and securing the waste with a free hand.

Another object of the present invention is to provide a waste collection and disposal device that is inexpensive and lightweight.

Another object of the present invention is to provide a waste collection and disposal device that does not require additional assembly or prep time prior to deployment.

Another object of the present invention is to provide a waste collection and disposal device that supplies a tight seal around any captured waste, containing any odors therein.

Another object of the present invention is to provide a waste collection and disposal device with a comfortable user interface for opening the receptacles, allowing for multiple deposits on a single excursion.

Another object of the present invention is to provide a waste collection and disposal device comprising a female receptacle with a tapered bottom edge to facilitate an efficient means to collect waste.

Another object of the present invention is to provide a waste collection and disposal device comprising a male and female receptacle in which the smaller dimensioned male receptacle contains the ability to slide into a female receptacle without any interference.

Another object of the present invention is to provide a secure attachment point for the means to join the male and female receptacles.

Yet another object of the present invention is to provide a comfortable means to pull the two adjacent boxes together when tension is applied by means of a soft, hypoallergenic and elastic material that acts as a handle.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a perspective view of the present invention while in an open configuration.

FIG. 2 shows a top view of the present invention in an open configuration prior to deployment.

DETAILED DESCRIPTION OF THE INVENTION

Figure 3:
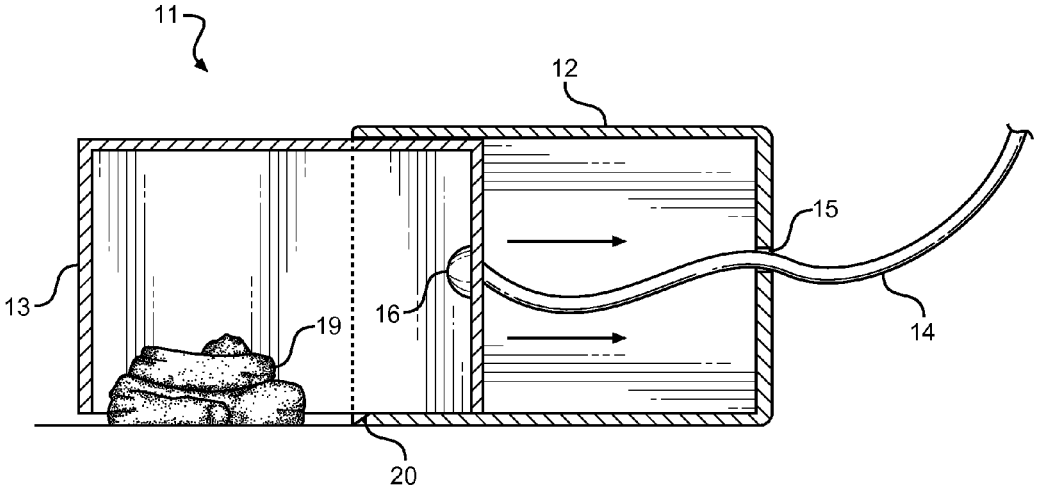
FIG. 3 shows a cross section view of the present invention from a side perspective wherein the contoured bottom edge of the female receptacle and pull string attachment point are visualized.

Reference is made herein to the attached drawings. Like reference numerals are used throughout the drawings to depict like or similar elements of the waste collection and disposal device. For the purposes of presenting a brief and clear description of the present invention, the preferred embodiment will be discussed as used for waste collection and disposal. The figures are intended for representative purposes only and should not be considered to be limiting in any respect.

Referring now to FIG. 1, there is shown a perspective view of the waste collection and disposal device 11 as described in the present invention. The device comprises two adjacent receptacles connected by a means to join them, wherein the two receptacles differ in both size and function. The smaller receptacle, referred to as the male receptacle 13, is initially deployed over the desired waste to be collected. Once the waste is fully enclosed, tension is applied to the means for joining the receptacles 14, forcing movement of the male receptacle 13 toward the other, larger receptacle, aptly named the female receptacle 12. During the joining process, the user may stabilize the female receptacle 12 by placing his or her foot thereon, allowing the male receptacle 13 to be drawn thereinto and the draw string joining means to overcome the friction therebetween. In order to facilitate a more stable union between the two receptacles a small rail may be attached on the interior surfaces of both female side walls with a corresponding and interlocking rail on the external surfaces of both male side walls. The rails will act as alignment points, positioning the incoming male receptacle in such a manner to reduce friction in the system, thereby reducing the required tension that is needed to join the receptacles. As the two receptacles join, the interior surface of the male receptacle's front wall pushes the waste toward the female receptacle until the chamfered bottom edge of the female receptacle acts as a scooping mechanism and captures the waste, thereby providing a means for sanitary containment.

The male and female receptacles are initially deployed with their respective center planes aligned in order to allocate the maximum and also equal tolerance relating to the distance between the male receptacle's outermost side wall surfaces and corresponding female receptacle's inner side wall surfaces. The means to join the male and female receptacles 14, such as a pull string, is routed through the center of the most rear-facing wall of the female receptacle, passing through a clearance hole 15 and entering the open volume therein, until it is securely attached 16 to the center of the most rear-facing wall of the male receptacle. The other end of the pull string is looped back onto itself and secured 17 using any one of an assortment of methods including glue, tape, a knot or a sewing stitch, thereby forming a handle 18 and providing convenience to a user while applying tension to the system. In order to provide a comfortable interface between the present device and a user, an elastic, non-allergenic and soft material is wrapped around the formed handle increasing ergonomics while joining the male and female receptacles. With the handle a user can sanitarily collect and dispose of the waste while in the standing position which negates medical concerns stemming from contact with animal waste.

Referring now to FIG. 2, there is shown a top view of the present invention 11 in a working manner. The female receptacle 12 is shown to be larger than the male receptacle 13, in order to facilitate the joining process without creating any interference. The pull string 14 is visualized entering the center of the female receptacle's rear wall 15, traveling through the inner volume until being secured 16 to the center of the male receptacle's rear wall. At this point, the pull string mechanism is securely attached with an adhesive solution such as glue or tape, or a knotted solution involving the formation of a knot on the inner plane of the male receptacle's rear wall having a circumference that exceeds the corresponding pass through hole. With a secure attachment, a user can apply tension to the pull string at the handle, forcing the male receptacle to move toward the female receptacle thereby enclosing the waste for future disposal.

The present invention offers several important improvements relating to devices currently found in the art, such as one-handed use and the collection of waste while in the standing position. By circumventing any possible physical contact with the animal waste while remaining in the standing position, a user can negate various medical concerns such as the transference of bacteria, parasites and viruses. Users who have physical disabilities or are unable to bend below the waste also benefit from this important attribute due to their lack of flexibility or risk of serious physical harm that can occur from attempting to collect the waste. The one-hand collection aspect of the current invention provides users with a free hand to perform arbitrary but necessary tasks related to the waste collection process such as wielding a flashlight to better spot the target area or rein in an overactive pet.

Referring now to FIG. 3, there is shown a cross section view of the present invention 11 while in a working manner. The male receptacle 13 is shown deployed over the waste to be collected 19 while the female receptacle 12 is beginning to encompass the male receptacle due to tension being applied to the pull string 14. The pull string, fabricated from a durable and inexpensive material such as twine, rope, fishing line or string, is shown passing through a clearance hole on the female receptacle's rear wall 15 before traveling through the inner volume and being secured to the center of the male receptacle's front wall 16. Once a secure attachment is established and tension applied to the system, the male receptacle 13 translates toward the female receptacle 12 with minimal distance existing between the exterior walls of the male receptacle and corresponding interior walls of the female receptacle 12 thereby negating any interference that can occur. A tapered or chamfered bottom edge 20 of the female receptacle is shown facilitating waste collection by providing a scooping mechanism to assist in propping up the waste. Once the waste is collected the device can be discarded in a sanitary fashion.

The present invention can be fabricated in numerous sizes in order to better serve the demand of users. Larger dimensioned male and female receptacles are an ideal solution for waste collection when dealing with larger breeds of dogs or other domesticated animals. Smaller versions can be made in order to provide a compact and easy to store device for smaller sized animals. The use of disposable, inexpensive and durable materials such as plastic, cardboard and composites can be used to fabricate the male and female receptacles in order to provide a low cost solution to users who have a need for waste collection and disposal devices.

Figure 4:
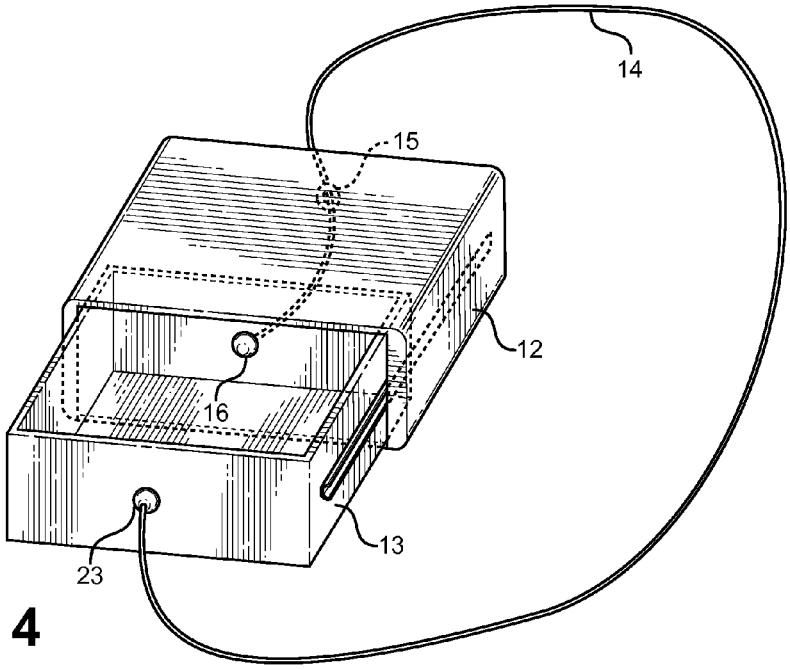
FIG. 4 shows an isometric view of the present invention with an additional embodiment relating to another attachment point for the pull string.

Referring now to FIG. 4, there is shown an isometric view of the present invention with an additional embodiment. The male 13 and female 12 receptacles are initially deployed with their respective center planes aligned in order to allocate the maximum and also equal tolerance relating to the distance between the male receptacle's outermost side wall surfaces and corresponding female receptacle's inner side wall surfaces. The means to join the male and female receptacles 14, such as a pull string, is routed through the center of the most rear-facing wall of the female receptacle, passing through a clearance hole 15 and entering the open volume therein, until it is securely attached 16 to the center of the most rear-facing wall of the male receptacle. The other end of the pull sting is routed through the center of the male receptacle's front wall and attached, in close proximity to the pass through hole, on the front wall's interior surface 23.

On occasion there exists a need to capture multiple deposits of waste on a single excursion. This need will require a user to open the disclosed invention by means of separating the male and female receptacles while contained waste exists therein. This can be safely accomplished by either manually pushing the male receptacle's rear wall facilitating it's separation, adding a small tab or handle like device to the center of the male receptacle's front wall which provides a convenient user interface or, as in FIG. 4, fabricating a pull sting that is attached on both ends thereby providing a user with enough slack to create an interface sufficient to pull the receptacles apart. Once the receptacles are separated a user can re-deploy the device and capture both waste deposits for future sanitary disposal It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A waste collection and disposal device, comprising:

a first and second adjacent male and female receptacle joined by a means to join said receptacles together and facilitate engagement;

said male receptacle having a front wall, rear wall, a pair of side walls and bottom wall forming a rectangular volume with an open upper end for accepting waste to be collected and disposed of;

said female receptacle having a rear wall, a pair of side walls, a top wall and a bottom wall forming a rectangular volume having an open front adjacent to said male receptacle for accepting said male receptacle therethrough and within said female receptacle's volume;

said means for joining said male and said female receptacles comprising a tether having a first and second end;

said first end of said tether passing through said female receptacle's rear wall and securely attaching to said male receptacle's rear wall;

said second end of said tether connected to said front wall of said male receptacle such that the free portion of said tether extends loosely from said front wall of said male receptacle around to said female receptacle rear wall.

2. The device of claim 1, wherein a front edge of said female receptacle bottom wall is chamfered.

3. The device of claim 1, wherein said male receptacle further comprises rails along said exterior side wall surface centers and said female receptacle further comprises corresponding interlocking rails on said inner side wall surface centers, aiding in the alignment of said receptacles during said joining process.

4. The device of claim 1, wherein said male and female receptacles are fabricated from materials of a disposable nature.

* * * * *